United States Patent [19]
Yoshinari et al.
[11] 4,177,782
[45] Dec. 11, 1979

[54] IGNITION SYSTEM PROVIDING SPARKS FOR TWO IGNITION PLUGS IN EACH CYLINDER FROM A SINGLE IGNITION COIL

[75] Inventors: Takashi Yoshinari; Terumi Ookado, both of Katsuta, Japan

[73] Assignee: Hitachi, Ltd., Japan

[21] Appl. No.: 846,891

[22] Filed: Oct. 31, 1977

[30] Foreign Application Priority Data

Nov. 1, 1976 [JP] Japan ..... 51/130493

[51] Int. Cl.[2] ..... F02P 3/02; H05B 41/02

[52] U.S. Cl. ..... 123/148 C; 315/180; 361/256; 315/183; 123/148 DS

[58] Field of Search ..... 123/148 DS, 148 C, 148 DC, 123/148 E, 149 C; 361/256, 263; 315/209 T, 180, 181, 183

[56] References Cited

U.S. PATENT DOCUMENTS

| | | | |
|---|---|---|---|
| 2,376,189 | 5/1945 | Robinson et al. | 315/180 |
| 3,045,148 | 7/1962 | McNulty et al. | 315/183 |
| 3,142,332 | 7/1964 | Weber et al. | 361/256 |
| 3,361,932 | 1/1968 | Campbell | 315/180 |
| 3,407,797 | 10/1968 | Ishibashi | 123/149 C |
| 3,902,471 | 9/1975 | Brungsberg | 315/209 T |

*Primary Examiner*—Charles J. Myhre
*Assistant Examiner*—Parshotam S. Lall
*Attorney, Agent, or Firm*—Craig and Antonelli

[57] ABSTRACT

Two ignition plugs are provided for each cylinder of an engine. Since it is desirable that these two plugs be sparked by one ignition coil, separate output terminal of a secondary coil of the ignition coil are respectively connected to each of the two plugs. An impedance circuit element is provided between one terminal of the secondary coil and ground to disturb a balance of the output voltages from the secondary coil terminals. The voltage of the other terminal of the secondary coil then reaches the break-down voltage between the air gap of its respective ignition plug first due to this imbalance of terminal voltages. The voltage of the one terminal then reaches the break-down voltage between the air gap of its respective ignition plug after the breaking-down of the other ignition plug. The two ignition plugs of each cylinder can thus be sparked at approximately the same time by providing the impedance circuit element between one output terminal of the ignition coil and ground.

7 Claims, 3 Drawing Figures

A.
Vs
Va
0
t
Vb
Vs
B.
Vs
Va
0
t
Vb
Vs
C.
Vs
Va
Vac
0
Vbc
Vb
Vs
t1
t2

IGNITION SYSTEM PROVIDING SPARKS FOR TWO IGNITION PLUGS IN EACH CYLINDER FROM A SINGLE IGNITION COIL

This invention relates generally to an ignition system, and more particularly to an ignition system wherein each cylinder has two ignition plugs for igniting the mixture of air-fuel gas.

It is an important problem to clean exhaust gas from a vehicle engine, and, more particularly, to reduce the amount of $NO_x$ in the exhaust gas. One solution to the problem is a system wherein a part of the exhaust gas returns to an intake manifold for introducing the exhaust gas into the combustion chamber. Unforunately, this introduction of the exhaust gas reduces the combustion speed in the combustion chamber and reduces the output of the engine.

It is possible to speed up the combustion by providing two ignition plugs for every cylinder with approximately the same timing spark for each of the two ignition plugs.

Ordinarily, when one thinks of providing the same timing for the spark of two ignition plugs, one has in mind two systems. One system has two ignition coils, each coil supplying energy to each ignition plug to produce the necessary ignition spark. In this system, it is necessary to provide two ignition coils and two control circuits for controlling the primary currents of the two primary windings of the ignition coils.

Alternatively, one could use a system with a double sparking coil. However, such a double suffers from the problem that it needs a high voltage larger than twice the brake-down voltage of each plug, and needs a current larger than the twice primary current of the ignition coil.

One of the object of this invention is to provide an ignition system wherein two ignition plugs provided to each cylinder are sparked at approximately the same time by one ignition coil with a current less than twice as large as the primary current.

Accordingly, in the present invention the voltage to spark the two ignition plugs is built up by only one ignition coil, with each output terminal of the ignition coil connected with each ignition plug. In order to spark the two ignition plugs with lower voltage, an impedance means is provided between the one output terminal and ground. The balance of the output voltage of the ignition coil is disturbed by the impedance means, and the voltage of the other terminal is built up. When the ignition plug is sparked by the voltage applied from the other terminal, the voltage of the one terminal is built up and the plug connected to said one terminal is also sparked.

IN THE DRAWINGS

Figure 1:
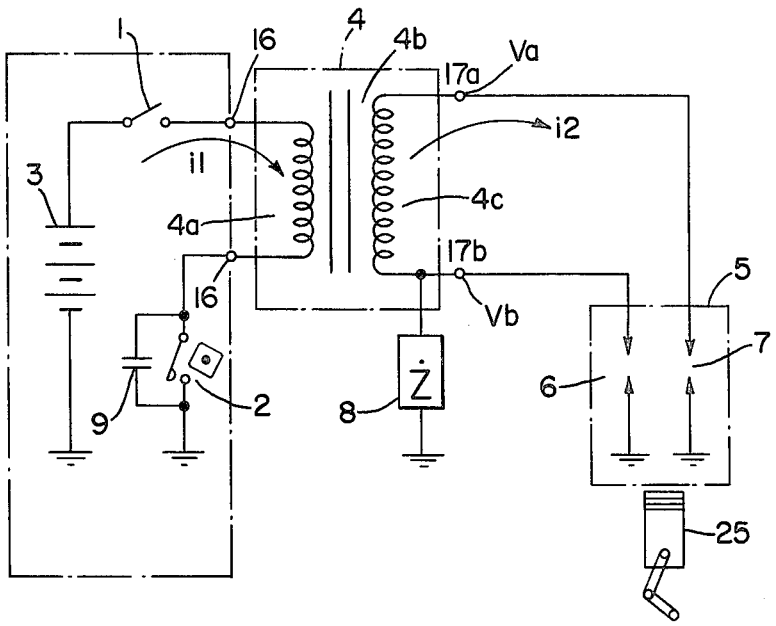
FIG. 1 is a schematic circuit diagram in accordance with this invention.

Referring now to FIG. 1, an ignition control circuit 21 comprises an ignition switch 1, a breaker 2, a battery 3 and a capacitor 9. A ignition coil 4 comprises a primary coil 4*a*, a secondary coil 4*c* and a magnetic core 4*b*. A cylinder 5 includes two ignition plugs 6 and 7 and piston 25. A series circuit of the ignition switch 1, the primary coil 4*a* and the breaker 2 is connected across the battery 3. The capacitor 9 is connected across the breaker 2. A closing operation of the breaker 2 supplies charging current $i_1$ into the primary winding 4*a* for generating a flux in the magnetic core 4*b* which links with a secondary winding 4*c*. When the breaker 2 is opened for interrupting the charging current $i_1$, high potential energy is induced in the secondary coil 4*c*. Since an impedance element 8 is provided between the output terminal 17*b* of the ignition coil 4 and ground, a closed circuit comprising the secondary coil 4*c*, the spark plug 7 and the impedance element 8 is created. At first, since the current can not flow, the voltage across the impedance element 8 is small. The high potential energy is applied to the spark plug 7, and then the spark is generated betwen the air gap of the spark plug 7.

Since the arc voltage is low, the voltage across the air gap of the plug 7 is stepped down by the breaking down of the air gap. Therefore, the voltage across the impedance 8 is stepped up and then the spark is created across the air gap of the plug 6.

Figure 2:
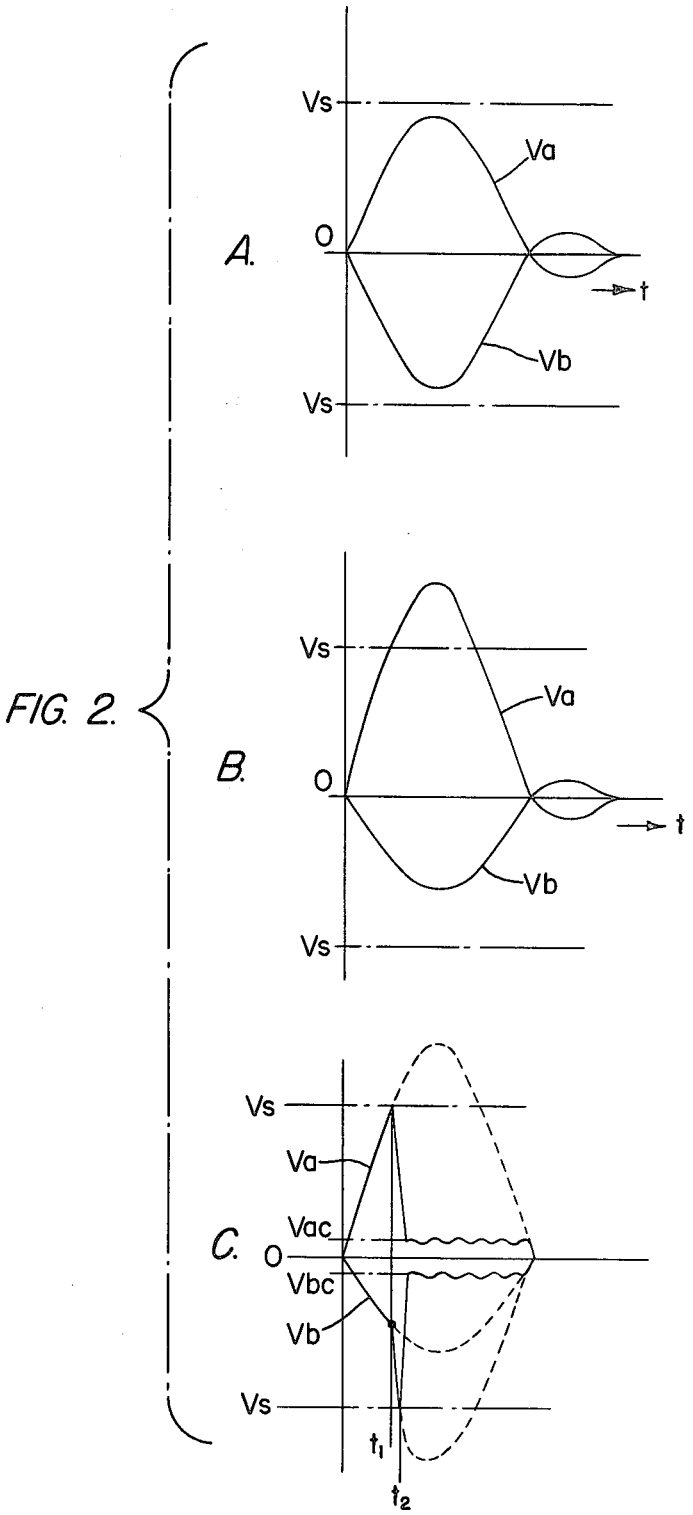
FIG. 2 is a wave form of the output voltage of the ignition coil in FIG. 1 for explaining the operation of the circuit diagram of FIG. 1.

Referring now to FIG. 2(*a*), when no impedance element is provided between the terminal 17*b* and ground, the terminal voltage Va of the terminal 17*a* and the terminal voltage Vb of the terminal 17*b* are balanced with each other, and neither of the terminal voltages Va and Vb can reach the respective break-down voltage of each air gap of the spark plugs. The balance of the two terminal voltages Va and Vb is lost by the provision of the impedance element 8, as shown in FIG. 2(*b*). The terminal voltage Va can therefore reach the break down voltage Vs of the air gap of the spark plug 7.

Referring now to FIG. 2(*c*), when the charging current is interrupted, the terminal voltage Va is abruptly built up over the break down voltage across the air gap of the spark plug 7, so that the ignition spark is caused across the spark plug air gap 7. The terminal voltage Va is stepped down inducing the spark of the ignition plug 7, and the terminal voltage Vb is stepped up over the break down voltage of the spark plug 6. Thus, the spark plug 6 is also ignited.

Specifically the opening of the breaker being operated as a switching means causes a sudden collapse of the magnetic field in the magnetic core 4*b* and induces high voltage in the secondary winding 4*c*. This high voltage is applied to the spark plugs 6 and 7 through a distributor (not shown). The high voltage is divided by the impedance Z of the impedance element 8 and an equivalent impedance of the air gap of the spark plug 7. Since the equivalent impedance of the spark plug 7 is larger than the impedance Z of the empedance element 8, referring to FIG. 2(*c*), at the time t1, the air gap of the spark plug 7 is broken down and the terminal voltage Vb is rapidly built up. At the time t2, the air gap of the spark plug 6 is also broken down. Therefore, the two air gaps of the spark plugs 6 and 7 are each broken down by the output from one secondary winding of the ignition coil 4. The duration between the time t2−t1 is negligible in comparison with the combustion speed of the air-fuel mixture.

As an impedance element 8, a resistor, a capacitor and an inductance can be used. An inductance has superior characteristics in providing a small value of impedance at the sparking condition of the spark plug 6 and a large value of impedance at the sparking condition of the spark plug 7. The desired capacitor offer certain advantages from the standpoint of cost. A value of capacitor is a few $10^{-11}$ [F] and can be provided in the ignition coil 4.

Figure 3:
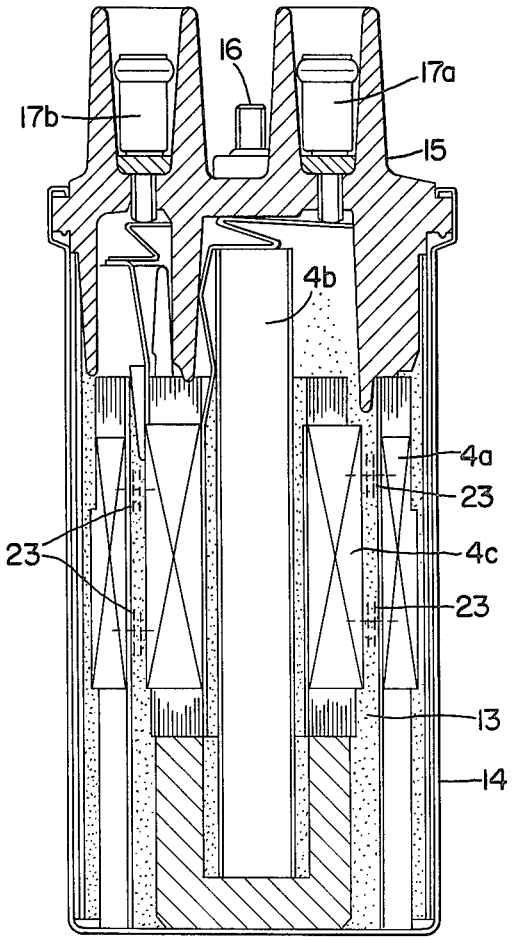
FIG. 3 is a sectional view of the ignition coil of FIG. 1.

Referring to FIG. 3, the structure of the coils 4a and 4c is devised for increasing capacitance between the secondary coil and ground. The secondary winding 4c is wound on the magnetic core 4b, and the primary winding 4a is wound on the secondary winding 4c. A case 14 encloses the primary winding 4a, the secondary winding 4c, the magnetic core 4b and an insulator such as an insulating oil. A cap 15 is secured to the case 14 with a fluid-tight seal.

Two terminals 16 secured to the cap 15 (one terminal is not shown in FIG. 3) are connected to each side of the primary coil 4a and used to connect the primary coil 4a to the ignition control circuit 21. Two terminals 17 are also secured to the cap for connecting the secondary winding 4c to the ignition plug through the distributor (not shown).

In this embodiment, the insulating space of the primary winding 4a and the secondary winding 4c is a few millimeters and this space serves as a capacitor 23. This capacitor 23 is not provided between the secondary winding and ground as shown in FIG. 1, but is provided instead between the primary winding and the secondary winding. This capacitor 23 is connected in series with the capacitor 9 being connected across the breaker 2. The series circuit comprising a capacitor 23, the primary winding 4a and the capacitor 9 is operated as a impedance element instead of the impedance element 8. Since ordinarily the microfarad value of the capacitor 9 is much smaller than the value of the capacitor 23, the influence of the capacitor 9 can be disregarded.

Some experimental data of the illustrated embodiment is described as follows:

Resistance of the primary winding 4a is 2.8 [Ω]
Resistance of the secondary winding 4c is 10.5 [kΩ]
Inductance of the primary winding 4a is 10.5 [mH]
Inductance of the secondary winding 4c is 110 [H]
Source voltage is 12 [V]
Facing angle of each side terminal and a center terminal of distributor is 52 degree The impedance 8 of FIG. 1 is changed as follows:

| impedance element 8 | voltage direction | output voltage | breakdown voltage |
|---|---|---|---|
| no element | (−) direction | 0 [kV] | no breakdown |
| | (+) direction | 34.5 [kV] | no breakdown |
| 0.5 [MΩ] | (−) direction | 11.5 [kV] | 32.5 [kV] |
| | (+) direction | 26.5 [kV] | 10.0 [kV] |
| 100 [$10^{-12}$F] | (−) direction | 10.0 [kV] | 32.5 [kV] |
| | (+) direction | 27.5 [kV] | 10.0 [kV] |

Referring to this experimental data, if no impedance element 8 is provided no ignition spark is created. But the provision of the impedance element 8 creates an ignition spark on both the ignition plugs.

In the embodiment of the FIG. 1, the breaker 2 is used for illustrating control of the primary current of the ignition coil. But it is generally preferable to employ a power transitor instead of the breaker 2.

In the present invention, the spark energy to the two ignition plugs can be applied by one ignition coil. Therefore, the significant advantage is achieved of controlling the two ignition plugs with a simple control circuit.

What is claimed is:

1. An ignition system for an internal combustion engine having at least one cylinder, comprising:
   an ignition coil having a primary winding and a secondary winding, said secondary winding having two output terminals;
   an ignition control circuit for applying a charging current to the primary winding of the ignition coil and for interrupting said charging current;
   two ignition plugs provided for each cylinder of the engine, each said ignition plug having at least one gap formed by two spaced apart electrodes,
   first connecting means for connecting one of the spaced apart electrodes of each gap of the two plugs to ground;
   second connecting means for connecting the other spaced apart electrode of one of the two plugs to one output terminal of the secondary winding of the ignition coil;
   third connecting means for connecting the other spaced apart electrode of the other of the two plugs to the other output terminal of the secondary winding of the ignition coil; and
   impedance means provided between only one of the output terminals of the secondary winding of the ignition coil and ground.

2. An ignition system in accordance with claim 1, wherein the impedance means is a capacitor.

3. An ignition system in accordance with claim 1, wherein the impedance means is a resistor.

4. An ignition system for an internal combustion engine having at least one cylinder, comprising:
   an ignition coil having a primary winding, a secondary winding, and a magnetic core, said secondary winding being wound on the magnetic core and said primary winding being wound on the secondary winding, and said secondary winding having two output terminals;
   an ignition control circuit including a switching means for applying a charging current to the primary winding of the ignition coil, and for interrupting said charging current;
   two ignition plugs provided on each cylinder of an engine, said each ignition plug has at least one gap formed by two spaced apart electrodes;
   first connecting means for connecting one of the spaced apart electrodes for each gap of the two plugs to ground;
   second connecting means for connecting the other spaced apart electrode of one of the two plugs to one output terminal of the secondary winding of the ignition coil;
   third connecting means for connecting the other spaced apart electrode of the other of the two plugs to the other terminal of the secondary winding of the ignition coil;
   impedance means provided between the secondary winding and the primary winding; and
   a capacitor provided between the primary winding and ground.

5. An ignition system in accordance with claim 4, wherein the impedance means is a capacitor.

6. An ignition system in accordance with claim 5, wherein the impedance means capacitor is formed by a dielectric layer formed between the primary and secondary windings.

7. An ignition system for an internal combustion engine having at least one cylinder, comprising:

an ignition coil having a primary winding and a secondary winding, said secondary winding having two output terminals;

an ignition control circuit for applying a charging current to the primary winding of the ignition coil and for interrupting said charging current;

two ignition plugs provided for each cylinder of the engine, each said ignition plug having at least one gap formed by two spaced apart electrodes, said gap each having a predetermined breakdown voltage;

first connecting means for connecting one of the spaced apart electrodes of each gap of the two plugs to ground;

second connecting means for connecting the other spaced apart electrode of one of the two plugs to one output terminal of the secondary winding of the ignition coil;

third connecting means for connecting the other spaced apart electrode of the other of the two plugs to the other output terminal of the secondary winding of the ignition coil; and impedance means provided between only one of the output terminals of the secondary winding of the ignition coil and ground to provide a voltage imbalance between the ignition plug coupled to the output terminal having the impedance means and the ignition plug coupled to the other output terminal so that the ignition plug coupled to the other output terminal receives a voltage sufficient to cause it to exceed the breakdown voltage of its gap first, after which breakdown the voltage across the ignition plug coupled to the terminal with the impedance means increases to a voltage sufficient to exceed the breakdown voltage of its gap.

* * * * *